US006119954A

United States Patent [19]

Kamath

[11] Patent Number: 6,119,954

[45] Date of Patent: Sep. 19, 2000

[54] AIR-ATOMIZING OIL AND/OR GAS BURNER UTILIZING A LOW PRESSURE FAN AND NOZZLE

[76] Inventor: Bola Kamath, 590 Whiskey Rd., Ridge, N.Y. 11961

[21] Appl. No.: 09/293,828

[22] Filed: Apr. 16, 1999

Related U.S. Application Data

[63] Continuation-in-part of application No. 08/822,360, Mar. 20, 1997.

[51] Int. Cl.[7] ..... B05B 7/10

[52] U.S. Cl. ..... 239/8; 239/406; 239/424; 239/424.5; 239/431; 239/434

[58] Field of Search ..... 239/8, 398, 403, 239/405, 406, 424, 424.5, 431, 434

[56] References Cited

U.S. PATENT DOCUMENTS

| | | | |
|---|---|---|---|
| 2,163,915 | 6/1939 | Reif et al. | 239/406 X |
| 2,219,696 | 10/1940 | Mueller et al. | 239/406 X |
| 3,644,077 | 2/1972 | Dimick | 239/406 X |
| 4,431,403 | 2/1984 | Nowak et al. | 239/405 X |

*Primary Examiner*—Andres Kashnikow
*Assistant Examiner*—Robin O. Evans
*Attorney, Agent, or Firm*—Galgano & Burke

[57] ABSTRACT

A burner utilizing a low pressure fan for atomizing fuel and supplying air for combustion. The burner includes an air-tube, an air-atomizing nozzle disposed in the air-tube, a conduit for supplying fuel to the nozzle, and a fan for supplying air to the air-tube. A back plate, a retention plate, and a side ring meter primary air to the nozzle and provide a chamber through which secondary air passes around the nozzle. The side ring is provided with a plurality of apertures for directing secondary air inwardly into a chamber desirably normal to the direction from which the secondary air is discharged therefrom. Also disclosed is a novel three-piece air-atomizing nozzle.

8 Claims, 7 Drawing Sheets

AIR-ATOMIZING OIL AND/OR GAS BURNER UTILIZING A LOW PRESSURE FAN AND NOZZLE

RELATED APPLICATION

This application is a Continuation-In-Part of application Ser. No. 08/822,360 filed on Mar. 20, 1997.

BACKGROUND OF THE INVENTION

The present invention relates generally to a novel air-atomizing oil and/or gas burner utilizing a low pressure fan, and a three-piece air-atomizing nozzle suitable for use therein. More particularly, it relates to such a novel burner which is configured to provide a uniform mixing of atomized fuel (i.e., oil and/or gas) and air for consistent ignition and efficient combustion.

Conventional air-atomizing oil burners offer the benefit of partially mixing oil with air prior to discharge from an orifice of a nozzle allowing the burner to operate at low firing rates compared to conventional oil burners which incorporate a pressure atomizing nozzle. In an air-atomizing oil burner, oil passes through the air-atomizing nozzle for combining with a high velocity air stream prior to discharge of atomized oil and air from the nozzle. Typically, a compressor supplies pressurized air at about 10 psi to about 100 psi to provide the required high velocity air supply.

With conventional air-atomizing oil burners, the high cost and unreliability of air compressors has limited the use of air-atomizing oil burners for residential heating. A recent attempt has been made to provide a low firing rate, air-atomizing oil burner suitable for residential heating that uses a low pressure fan powered by an expensive brushless DC motor to supply air at a pressure of about 6 to 12 inches of water (0.21 psi to 0.92 psi). Drawbacks with such air-atomizing oil burners are the complexity and high cost associated with fabricating the air-atomizing nozzle and the inability to regulate the supply of the low pressure air from the fan to provide a stable uniform mixture of atomized oil and air for consistent ignition and efficient combustion.

For example, FIG. 1 shows a diagrammatic illustration of a prior art air-atomizing oil burner 10 having a low pressure fan 12 which provides a primary air supply, a secondary air supply, and a tertiary air supply. Primary air passes through air-atomizing nozzle 20, secondary air passes through a back plate 14 and a retention plate 16, and tertiary air passes between back plate 14 and air cone 18. As best seen in FIG. 2, a drawback with this prior art design is that a plurality of holes 19 in back plate 14 produce high pressure points. The turbulent air which exits holes 19 rushes toward retention plate 16 and discharges out louvers 17. This turbulent secondary air which exits louvers 17 unevenly mixes with the discharge of atomized oil and air from nozzle 20 resulting in inconsistent ignition and uneven combustion.

As shown in FIG. 3, air-atomizing nozzle 20 in burner 10 comprises an outer body 21, an end cap 24, a swirler 26, an inner body 22, a fuel distributer 23 fitted to inner body 22, and a pair of O-rings 28. Thus, this prior art nozzle requires six separate parts which must be precisely machined and subsequently assembled together which obviously makes it relatively expensive.

SUMMARY OF THE INVENTION

Accordingly, it is the object of the present invention to provide a low cost marketable air-atomizing oil and/or gas burner utilizing a low pressure fan which is desirably suitable for residential heating and configured to provide a generally uniform mixture of air and atomized fuel (i.e., oil and/or gas) to enable consistent ignition and efficient combustion.

It is also an object of the present invention to provide an air-atomizing fuel oil (i.e., and/or gas) burner in which the flow of secondary air is stabilized prior to combining with atomized oil to provide a generally uniform mixture of air and atomized fuel (i.e., oil and/or gas) enabling consistent ignition and efficient combustion.

It is another object of the present invention to provide such a burner in which secondary air is metered into a chamber at about 90 degrees to the direction from which the secondary air exits the chamber to mix with atomized oil and/or gas.

It is another object of the present invention to provide such a burner in which secondary air aids flame retention.

It is another object of the present invention to provide such a burner in which secondary air directs an ignition spark toward the combustible fuel/air mixture during ignition.

It is still another object of the present invention to provide such a burner in which a low pressure fan and oil pump are powered by a single motor.

It is yet another object of the present invention to provide such a burner having a low cost three-piece air-atomizing nozzle.

It is a further object of the present invention to provide such a burner that is may be manufactured easily and inexpensively for widespread use in residential heating systems.

Certain of the foregoing related objects are also achieved in an air-atomizing fuel burner comprising:

an air-tube;

an air-atomizing nozzle disposed in said air-tube, said nozzle having a longitudinally extending axis;

a conduit for supplying a combustible fuel to said nozzle;

a fan for providing a supply of air to said air-tube; and means for metering the supply of air in said air-tube to provide a primary supply of air to said nozzle and a secondary supply of air around said nozzle, said metering means defining a chamber into which secondary air is directed inwardly toward said axis of said nozzle.

Certain of the foregoing related objects are also achieved in a three-piece air-atomizing nozzle comprising:

a fuel distributor having a fuel passageway extending therethrough, said fuel distributor having a discharge end having at least one aperture extending from said fuel passageway and opening onto an outer surface of said discharge end;

a tubular outer body attachable to said fuel distributor and spaced from said discharge end of said fuel distributor to define a primary air passageway, said outer body having at least one inlet for receiving primary air into, and at least one outlet for discharging primary air from, said air passageway; and a swirler extending between said outer body and said discharge end of said fuel distributor, said swirler spaced-apart from said discharge end of said fuel distributor to define a fuel atomizing passageway, said swirler having at least one inlet for receiving a first portion of the primary air into said fuel atomizing passageway and an atomized fuel discharge outlet, and said swirler having a plurality of vanes spaced between said swirler and said outer body for imparting a swirling motion to a second portion of the primary air.

Certain of the foregoing related objects are also achieved in a method for atomizing oil with air for combustion, comprising the steps of:

arranging an air-atomizing nozzle in an air-tube, said nozzle having a longitudinally extending axis;

feeding a supply of fuel to said nozzle for discharge therefrom;

feeding a supply of air to said air-tube for discharge therefrom, such that atomized fuel is mixed with air for combustion; and metering said supply of air in said air-tube to provide a primary supply of air to said nozzle and a secondary supply of air around said nozzle, such that said secondary air is directed inwardly toward said axis of said nozzle.

BRIEF DESCRIPTION OF THE DRAWINGS

Other objects and features of the present invention will become apparent from the following detailed description considered in connection with the accompanying drawings, which disclose one embodiment of the invention. It is to be understood that the drawings are to be used for the purpose of illustration only and not as a definition of the limits of the invention.

In the drawings, wherein similar reference characters denote similar elements throughout the several views.

DETAILED DESCRIPTION OF A PREFERRED EMBODIMENT

Figure 4A:
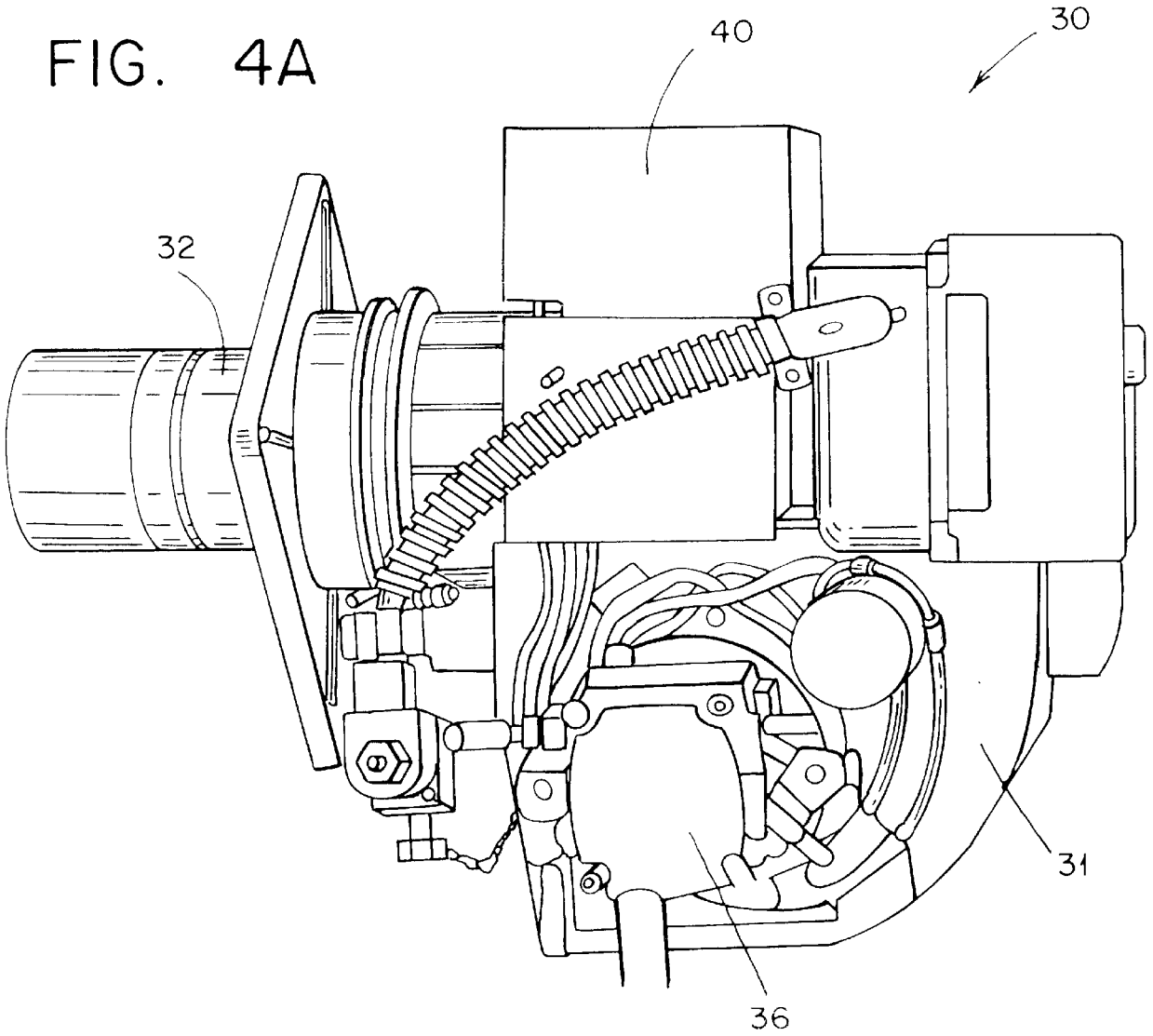
FIGS. 4A and 4B are side elevational and rear elevational views, respectively, of one embodiment of an air-atomizing oil burner according to the present invention.
Figure 4B:
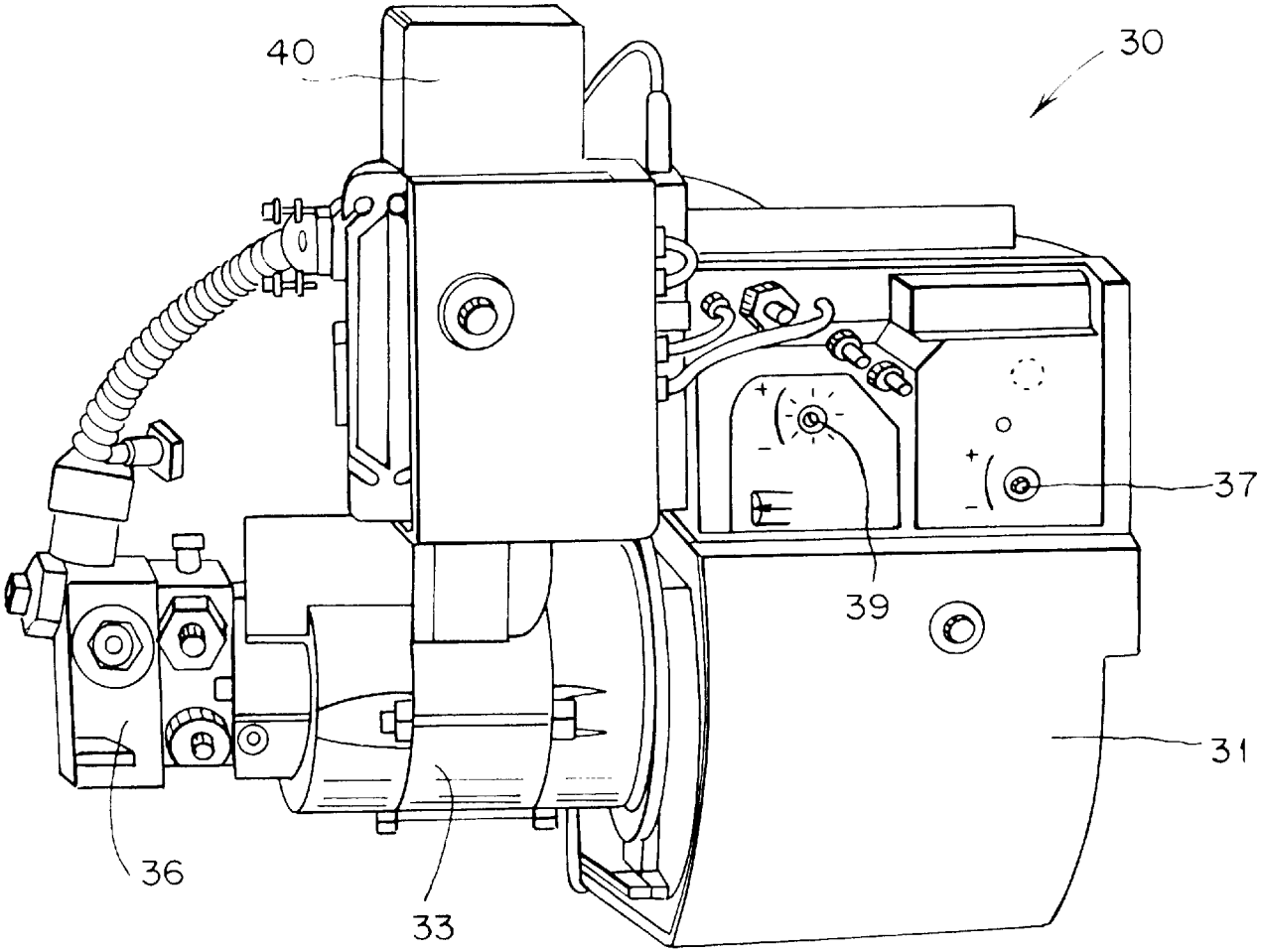

Turning now to the drawings and in particular to FIGS. 4A and 4B, therein illustrated is one embodiment of a compactly configured air-atomizing oil burner 30 according to the present invention for use in residential heating systems. Burner 30 generally comprises a housing 31, an air-tube 32 (FIG. 4A), a motor 33 (FIG. 4B) for powering an oil pump 36 and a low pressure fan 34 (best seen in FIG. 5), and an ignition transformer 40. As used herein, "low pressure" means a pressure under 10 psi, and preferably a pressure less than 2 psi, and most preferably, from about 0.1 psi to 0.35 psi.

Figure 5:
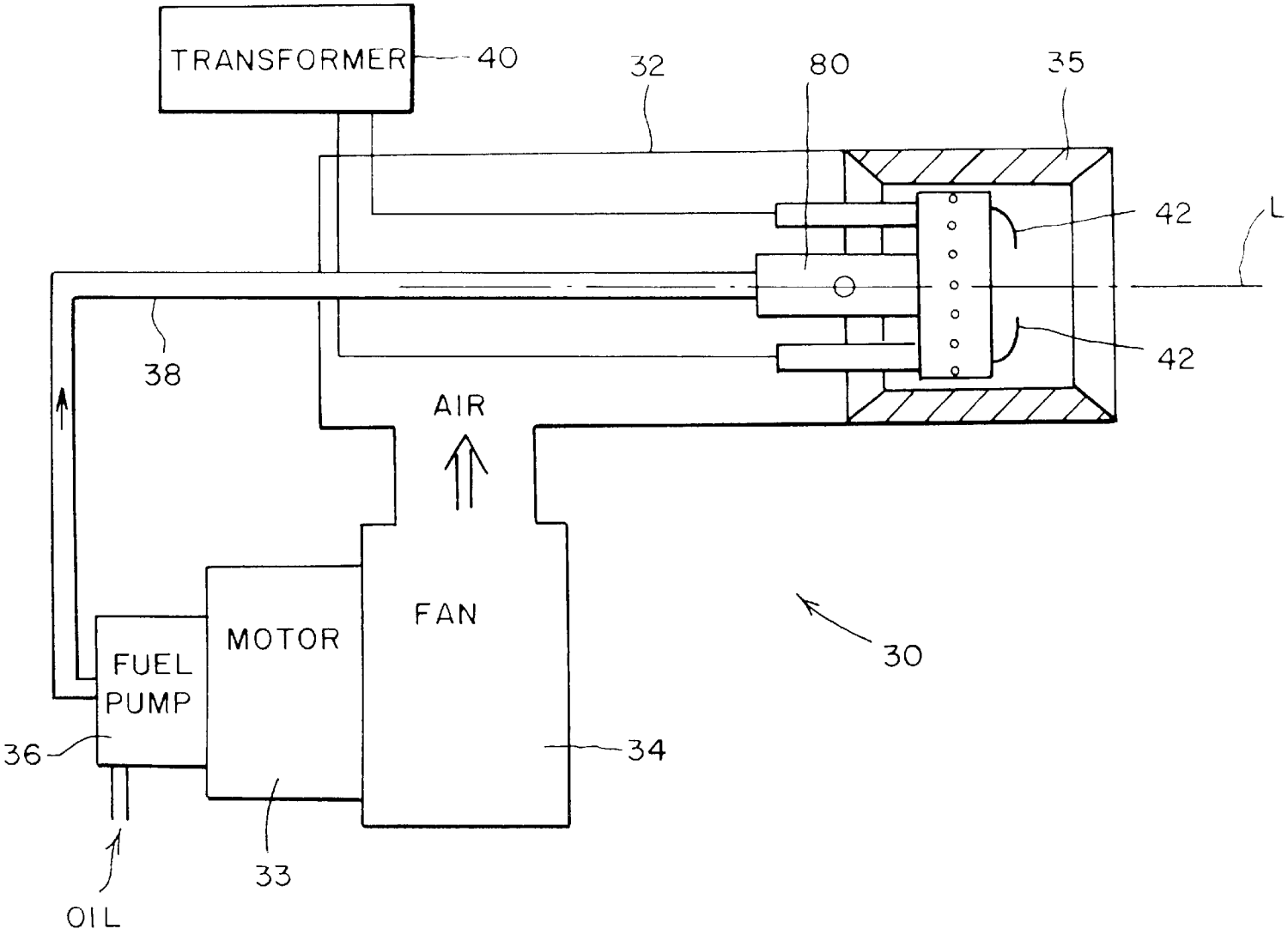
FIG. 5 is a diagrammatic view of the burner shown in FIG. 4 illustrating the inside thereof.

As diagrammatically shown in FIG. 5, burner 30 comprises an air-atomizing nozzle 80 disposed in air-tube 32 desirably along the longitudinally-extending axis L thereof. Motor 33 powers both fan 34 for supplying air for atomization and combustion to air-tube 32, and fuel or oil pump 36 for supplying oil via a conduit 38 to nozzle 80. For ignition, transformer 40 operably provides a high voltage charge to electrodes 42 to produce a spark and initiate start-up.

Figure 1:
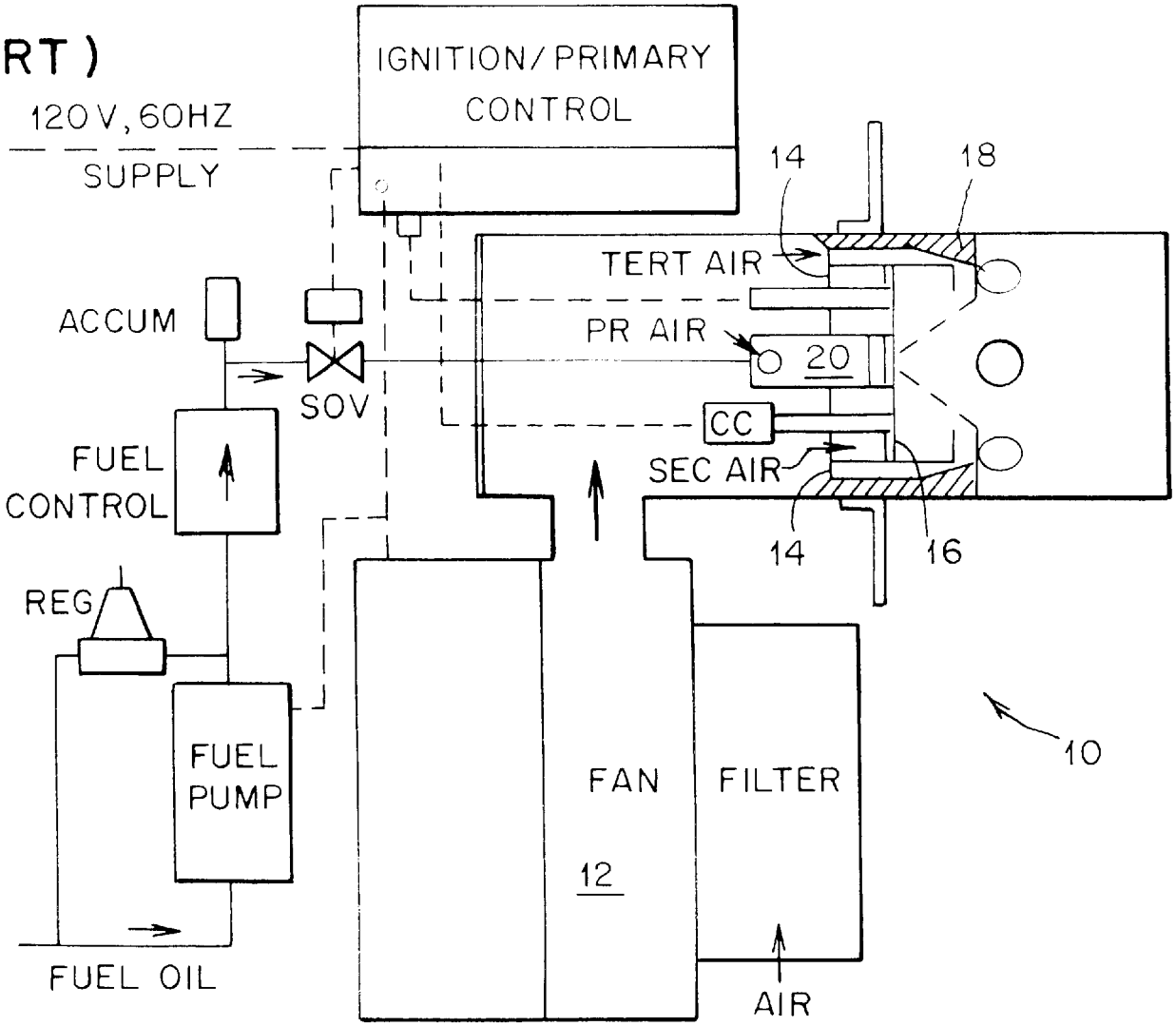
FIG. 1 (PRIOR ART)
FIG. 1 is a diagrammatic view of a prior art air-atomizing oil burner.
Figure 2:
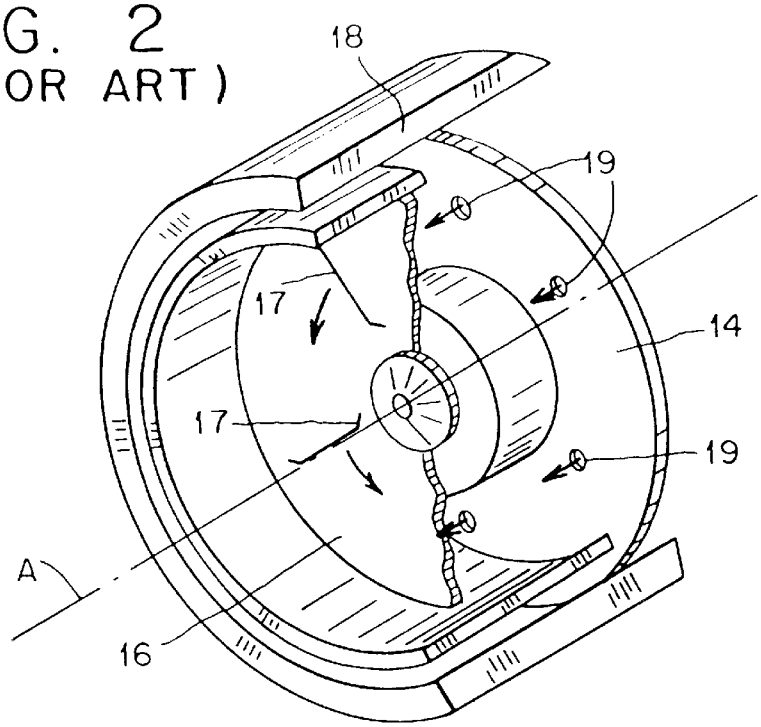
FIG. 2 (PRIOR ART)
FIG. 2 is a perspective view, part broken away, of the burner head of the prior art burner shown in FIG. 1.
Figure 6:
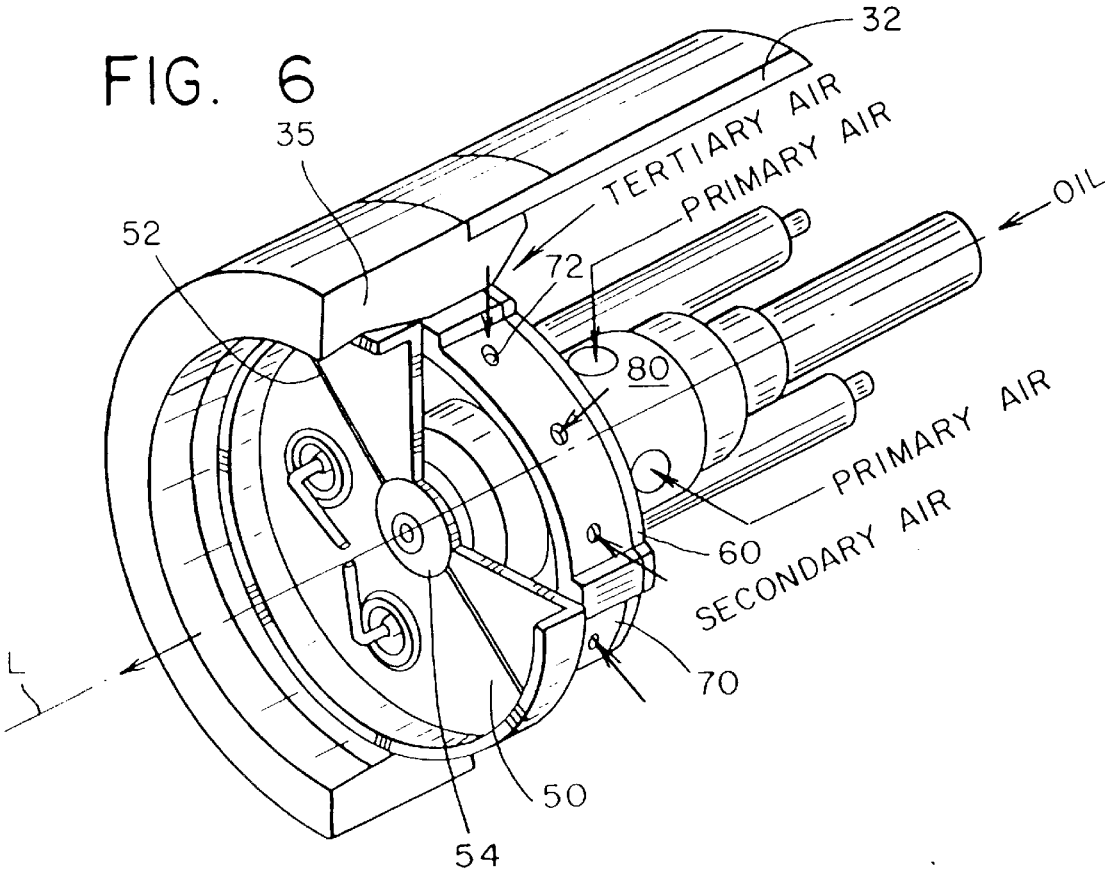
FIG. 6 is a perspective view, part broken away, of the burner head of the burner shown in FIG. 4.

FIG. 6 more clearly illustrates the burner head portion of burner 30 in which the supply of air from fan 34 (not shown in FIG. 6) is apportioned into primary, secondary and tertiary air supplies which provides the required air for atomizing the oil and for combustion. Specifically, primary air enters nozzle 80 for atomizing and combining with the supply of oil as discussed in greater detail hereinafter.

Figure 3:
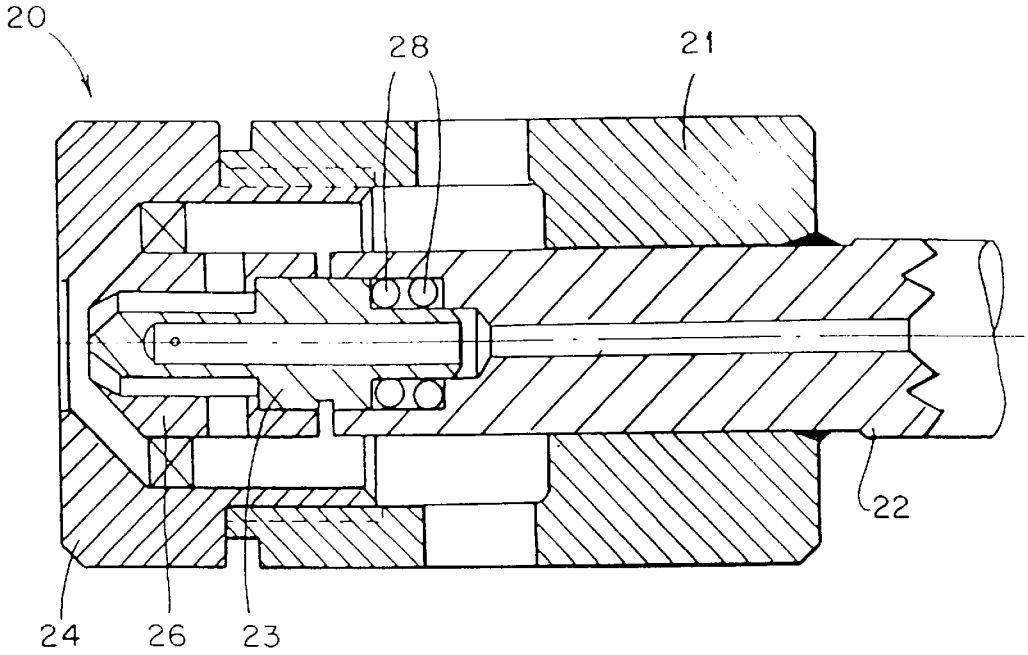
FIG. 3 (PRIOR ART)
FIG. 3 a cross-sectional view of the air-atomizing nozzle of the prior art burner shown in FIG. 1.
Figure 7:
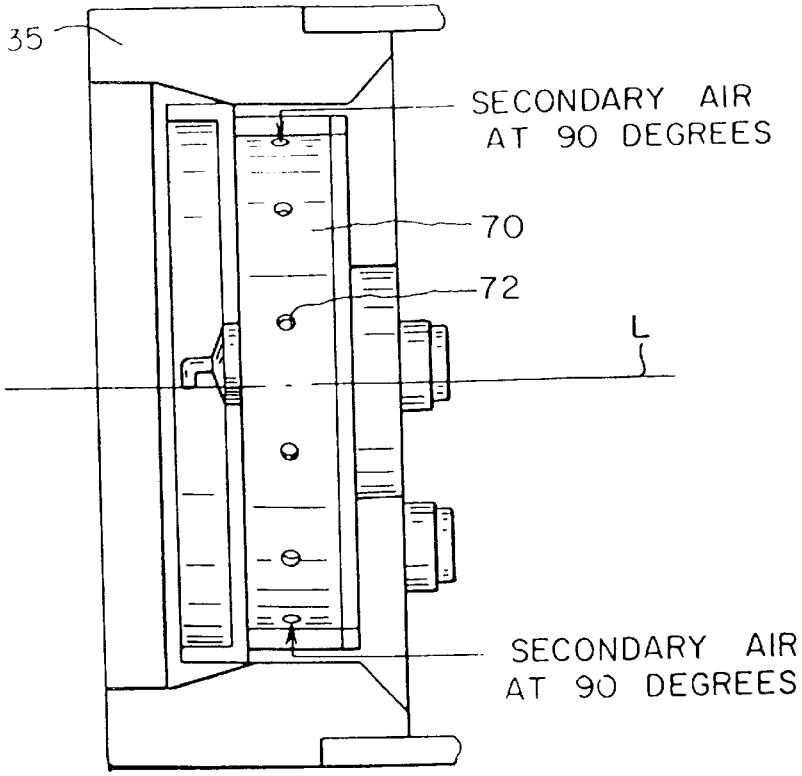
FIG. 7 is a side elevational view, part broken away, of the burner head shown in FIG. 6.

Secondary air and tertiary air are metered and pass around nozzle 80. To provide a generally uniform supply of atomized oil and air for ignition and combustion, the flow rate of secondary air is reduced and stabilized prior to mixing with the atomized oil and air discharged from nozzle 80. In particular, a circular back plate 60, an annular side ring 70, and a circular retention plate 50 provide a chamber therebetween through which secondary air passes. Side ring 70 is provided with a plurality of apertures 72 which extend through side ring 70 so that air enters the chamber inwardly toward longitudinal axis L. As best seen in FIG. 7, apertures 72 are desirably positioned normal (i.e., about 90 degrees) to longitudinally extend axis L. In this illustrated embodiment, axis L also corresponds generally to the flow of oil through nozzle 80. From the present description, it will be appreciated to those skilled in the art that the apertures in the side ring can be angled from a radial line extending from the center of the ring so as to impart a swirling motion to air entering the chamber. This design, with apertures on the side ring, reduces turbulent high pressure points of secondary air associated with the prior art design shown in FIG. 3, in which metering holes 19 positioned on back plate 14 extend parallel to the longitudinal axis A of an air-cone 18 and nozzle 20.

Referring again to FIG. 6, the stabilized secondary air subsequently discharges through louvers 52 in retention plate 50 which imparts a swirling motion to the flow of secondary air. In addition, the passage of secondary air through apertures 72 in side ring 70 imparts an inwardly directed air flow component to the secondary air flow which reduces the natural tendency of the secondary air flow to spread outwardly upon discharge from louvers 52 in retention plate 50 thereby providing flame retention and directing an ignition spark toward the combustible fuel/air mixture during ignition. The swirling secondary air evenly combines with the discharge of air and atomized oil from nozzle 80 to provide a generally uniform mixture of atomized oil and air for consistent and efficient combustion. From the present description, it will be appreciated to those skilled in the art that secondary air can also be made to exit from a gap between an aperture 54 in retention plate 50 and the forward end of nozzle 80.

Tertiary air is metered between the outer edge of retention plate 50 and the inside of an air-cone 35, which extends from air tube 32, for subsequent mixing with the atomized oil and air discharged from nozzle 80, and the secondary air supply. Desirably, primary air consists of 45 percent, secondary air consists of 30 percent, and tertiary air consists of 25 percent of the total air required for combustion.

Figure 9:
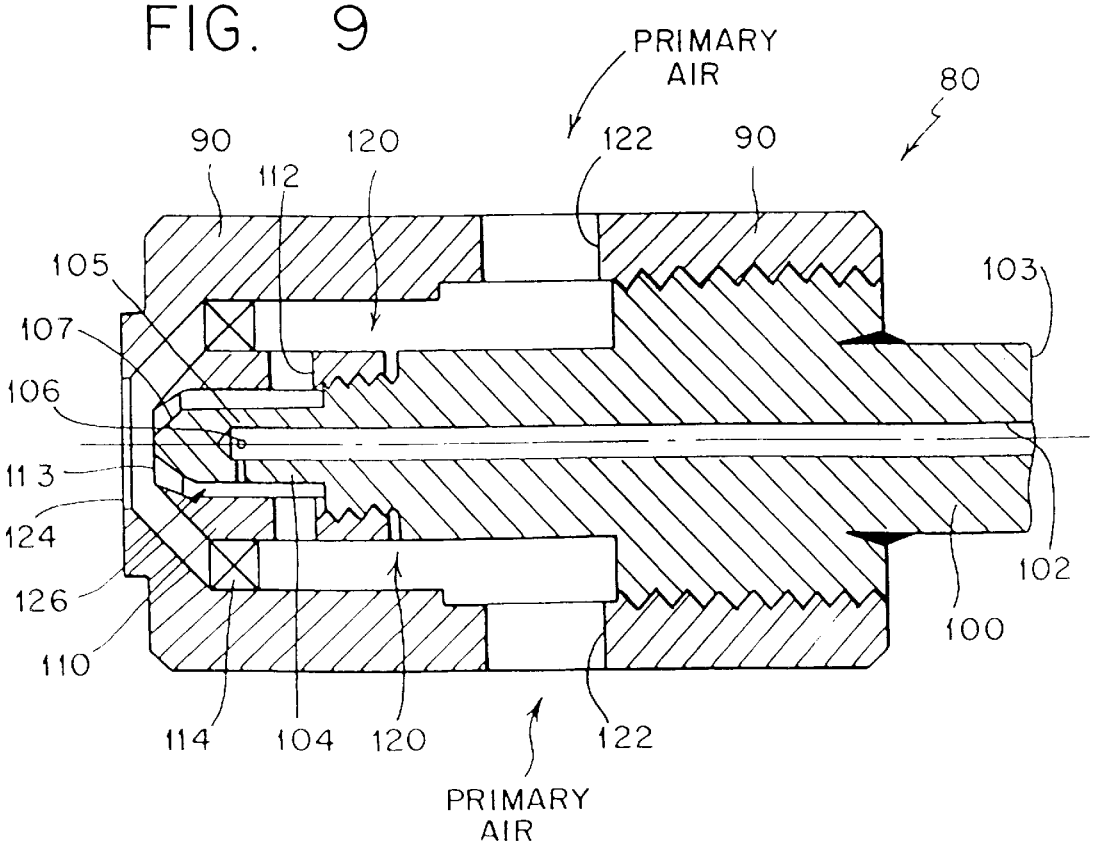
FIG. 9 is a cross-sectional view of the air-atomizing nozzle of the oil burner shown in FIG. 6.
Figure 8:
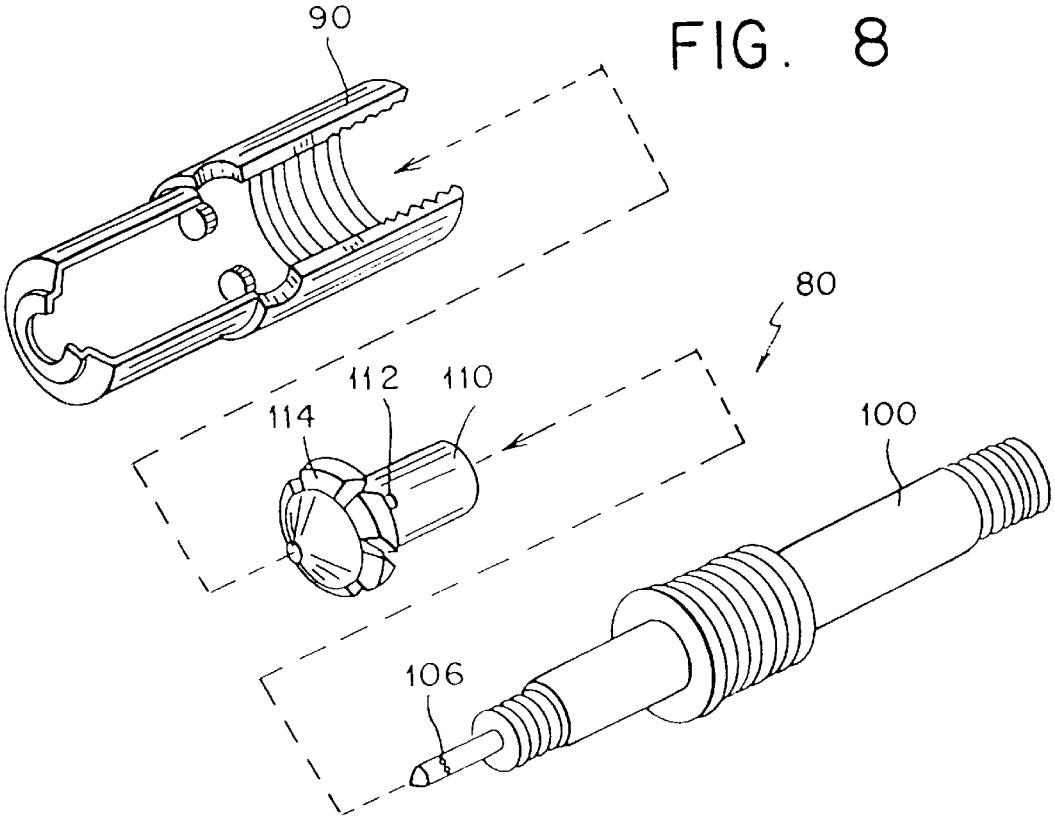
FIG. 8 is an exploded perspective view of the nozzle shown in FIG. 6.

Referring now to FIGS. 8 and 9, nozzle 80 comprises three components, namely, an outer body portion 90, a fuel distributer 100, and a swirler 110. As best seen in FIG. 9, fuel distributer 100 has a longitudinally-extending oil passageway 102 which is fed by oil pump 36 via conduit 38 (FIG. 5). Fuel distributer 100 also includes an oil discharge end 104 in which a plurality of apertures 106 allow oil to exit oil passageway 102. Desirably, oil discharge end 104 has a cylindrically-shaped inner portion 105 and a conically-shaped outer portion 107 with apertures 106 opening onto the outer surface of cylindrical-shaped inner portion 105. With oil supplied at a pressure of about 3 psi to 10 psi, oil sprays from aperture 106 at 90 degrees to the flow of the supply of primary air as further explained below.

Cylindrical outer body portion 90 threadably attaches to fuel distributor 100 and is spaced-apart therefrom so as to define a primary air passage 120 therebetween. Outer body portion 90 is provided with a plurality of inlets 122 for receiving primary air and which lead to primary air passage 120, as well as a discharge orifice 124 from which the primary air in air passage 120 exits.

Spanning between the inner surface of outer body 90 and fuel distributer 100 is a swirler 110 which desirably threadably attaches to fuel distributer 100. Swirler 110 is spaced-apart from the discharge end 104 of fuel distributer 100 to define an oil atomizing passageway 124. In addition, swirler 110 is provided with a plurality of inlets 112 for receiving a first portion of the primary air for atomizing the oil discharged from fuel distributer 100 which discharges from an atomized oil discharge outlet 113. Swirler 110 includes a plurality of vanes 114 which impart a swirling motion to the second portion of the primary air. Preferably, vanes 114 are angled (best seen in FIG. 8) for imparting a swirling motion to the second portion of primary air. In addition, inlets 112 can be angled to one side of a radially extending line to impart a swirling motion to the first portion of the primary air. Vanes 114 and inlets 112 can be configured to impart a swirling motion to the air either in the same direction or in opposite directions. From the present description, it will be appreciated to those skilled in the art that nozzle 80 is easily manufactured and assembled. In particular, assembly only requires attaching swirler 110 to fuel distributor 100 and then attaching outer body 90 to fuel distributor 100. Desirably, nozzle 80 can also include a filter for filtering the oil, e.g., a 1000 micron filter which attaches to end 103 of fuel distributor 100.

The operation of burner 30 is as follows. Referring again to FIG. 5, upon start-up fan 34 is operated to provide a supply of air. A supply of oil is provided to nozzle 80 while simultaneously transformer 40 energizes electrodes 42 located in the desired flame envelope to produce a spark and the fuel/oil mixture is ignited.

Referring still to FIG. 5, fan 34 supplies the required air for atomizing the oil and combustion. Desirably, fan 34 provides a supply of air at a pressure of about 3 inches of water to about 10 inches of water (about 0.1 psi to about 0.35 psi) and at air flows varying from about 2 cubic feet per minute (cfm) to 30 cfm. Most desirably, the supply of air is at a pressure of about 5 inches to 6 inches of water (about 0.2 psi). A suitable fan 34 is available from Bentone AB of Ljungby, Sweden, model number ST133/ST146.

Oil pump 36 desirably provides oil at an approximately constant pressure of about 3 psi to about 10 psi. It will be appreciated to those skilled in the art that a regulator can be installed in the conduit between the oil pump and the nozzle to maintain the oil delivered to the nozzle at a constant pressure. A suitable oil pump is manufactured by Suntec Industries of Rockford, Ill., model number A2RA7737. It is also appreciated that the oil can be supplied and regulated by a suitable fuel injector. At the above-noted oil pressure and air pressure, the present oil burner has a firing rate of about 0.3 gallons per hour (gph) to about 0.65 gph.

As described above, motor 33 powers both fan 34 and oil pump 36. Preferably, motor 33 is an efficient permanent split capacitor AC electric motor. A suitable motor is manufactured by Simel S.p.A. of Ferrara, Italy, model number DS213254.

From the present description, it will be appreciated to those skilled in the art that air-atomizing oil burner can be configured to adjustably vary the flow of oil to the nozzle, and adjustably vary the air supply, e.g., by changing the various pressures and/or moving the burner head, i.e., nozzle, backplate, side ring and retention plate relative to the air-tube and air cone. As illustrated in FIG. 4B, burner 30 is provided with controls 37 for varying the flow rate of air, and controls 39 for moving the burner head. Desirably, a sensor or cad cell is provided to monitor the firing of the burner, and the burner can be suitably connected and operable via controls such as a thermostat in a home or a sensor in a hot water heater.

As can be appreciated, although the invention has been described in detail with respect to the use of the inventive burner nozzle with liquid fuel (i.e., oil), it may also be used with a gaseous fuel (i.e., butane or any other home heating gaseous fuel) or a combination gas-liquid fuel mixture.

Thus, while only one embodiment of the present invention has been shown and described, it will be appreciated to those skilled in the art that many changes and modifications may be made thereunto without departing from the spirit and scope of the invention.

What is claimed is:

1. An air-atomizing fuel burner comprising:

an air-tube;

an air-atomizing nozzle disposed in said air-tube, said nozzle having a longitudinally extending axis;

a conduit for supplying a combustible fuel to said nozzle;

a fan for providing a supply of air to said air-tube;

an air-cone attached to and extending from said air-tube; and means for metering the supply of air in said air-tube to provide a primary supply of air to said nozzle and a secondary supply of air around said nozzle, said metering means defining a chamber into which secondary air is directed inwardly toward said axis of said nozzle at an angle of about 90 degrees to said axis and wherein said metering means and at least one of said air-tube and said air-cone meters the supply of air in said air-tube to provide a tertiary supply of air.

2. The burner according to claim 1, wherein said metering means discharges secondary air in a swirling motion around said nozzle.

3. The burner according to claim 1, wherein said metering means comprises a side ring comprising a plurality of apertures.

4. The burner according to claim 3, wherein said metering means comprises a back plate, a retention plate spaced from said back plate and said side ring joining said back plate and said retention plate to define said chamber therebetween.

5. The burner according to claim 4, wherein said retention plate comprises a plurality of louvers for imparting a swirling motion to the discharge of secondary air.

6. The burner according to claim 1, wherein said fan supplies air at a pressure of about 3 inches of water to about 10 inches of water.

7. The burner according to claim 6, wherein said fan supplies air at a pressure of about 5 inches of water to about 6 inches of water.

8. A method for atomizing oil with air for combustion, comprising the steps of:

arranging an air-atomizing nozzle in an air-tube to which an air-cone is attached, said nozzle having a longitudinally extending axis;

feeding a supply of fuel to said nozzle for discharge therefrom;

feeding a supply of air to said air-tube for discharge therefrom, such that atomized fuel is mixed with air for combustion; and metering said supply of air in said air-tube via metering means comprising a back plate, a retention plate spaced from said back plate, and a side ring joining said back plate and said retention plate to define a chamber therebetween, and wherein said side ring is provided with a plurality of apertures to provide a primary supply of air to said nozzle, a secondary supply of air around said nozzle via said apertures, such that said secondary air is directed inwardly at an angle of about 90 degrees to said axis of said nozzle, and a tertiary supply of air between said air-cone and said retention plate.

* * * * *